US006920301B2

(12) United States Patent
Arimoto

(10) Patent No.: US 6,920,301 B2
(45) Date of Patent: Jul. 19, 2005

(54) ROTARY DEVELOPING APPARATUS WITH DEVELOPER RECOVERY

(75) Inventor: Kota Arimoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/206,981

(22) Filed: Jul. 30, 2002

(65) Prior Publication Data

US 2003/0026628 A1 Feb. 6, 2003

(30) Foreign Application Priority Data

Jul. 31, 2001 (JP) ..... 2001-231389

(51) Int. Cl.[7] ..... G03G 15/01; G03G 15/08
(52) U.S. Cl. ..... 399/227; 399/120; 399/257
(58) Field of Search ..... 399/227, 257, 399/120

(56) References Cited

U.S. PATENT DOCUMENTS 5,752,141 A 5/1998 Nishimura et al. ..... 399/227

FOREIGN PATENT DOCUMENTS

JP 2-21591 B2 5/1990
JP 9-218575 8/1997
JP 10-142888 5/1998
JP 10-186854 7/1998
JP 11-65216 A * 3/1999

* cited by examiner

*Primary Examiner*—Joan Pendegrass
(74) *Attorney, Agent, or Firm*—Fitzpatrick, Cella, Harper & Scinto

(57) ABSTRACT

A developing apparatus is equipped with a developing container accommodating a developer including a toner and a carrier to develop at a developing position an electrostatic image formed on an image bearing member, a rotor for rotating the developing container in a path including the developing position, and a developer replenishing container for replenishing the developing container situated at the developing position by said rotor with the developer. An opening is provided on a side surface of the developing container, which allows surplus developer to spill out of said developing container situated at said developing position by said rotor. The apparatus is further equipped with a recovering container and a member for opening/closing the opening mentioned above. The recovering container recovers the surplus developer discharged from said opening utilizing a rotational motion of said rotor.

10 Claims, 10 Drawing Sheets

ROTARY DEVELOPING APPARATUS WITH DEVELOPER RECOVERY

BACKGROUND OF THE INVENTION

1. Field of the Invention

The present invention relates to a developing apparatus for use in a copying machine, a printer, a facsimile machine or other machines that use an electrophotography scheme, electrostatic recording scheme or the like.

2. Description of the Related Art

The following method has been generally used in image forming apparatus that forms color images using, for example, an electrophotography scheme. That is, toner images of plural colors are sequentially formed on an electrophotographic photosensitive member (photosensitive member) as an image bearing member, so that the toner images of plural colors are superposed on a transferring medium such as a recording sheet sequentially or at one time.

In the past, in that type of image forming apparatus for forming color images, a so-called rotary developing method has been proposed and put to practical use. The rotary developing method is such a method in which a rotor mounted with developing units for respective colors such as black, yellow, magenta and cyan is rotated so as to sequentially bring the developing units to be used to a position opposed to a photosensitive member, at which developing operations are performed.

On the other hand, in conventional image forming apparatus, especially in image forming apparatus that form color images, a two-component developing method that uses a mixture comprised principally of non-magnetic toner and magnetic carrier as a two-component developer has been widely used.

The two-component developing method has advantages with respect to stability in image quality and durability of apparatus as compared to other developing methods presently proposed. However, long term use of the image forming apparatus of the two-component developing method inevitably involves deterioration of the developer and especially deterioration of the carrier, so that replacement of the developer is required, which has invited an increase in service costs and operating costs.

Some measures for solving the above problem have been proposed. Especially, a so-called trickle developing method has been put to practical use, which replenishes the developing device in the rotary developing method, with the two-component developer utilizing changes in the direction of the gravitational force involved by the rotation of the rotor and also discharges the two-component developer from the developing device utilizing the same principle.

For example, Japanese Patent Application Laid-open No. 9-218575 discloses a rotary developing apparatus as shown in annexed FIG. 11 of the present application, in which a developing device 101 is replenished with developer including an amount of toner for supplementing the toner consumed in the developing operation at the developing position P1 at which the developing device 101 is opposed to a photosensitive member 128, and surplus toner in the developing device 101 is discharged therefrom and recovered by a developer cartridge 105 through a recovering port 111, a discharge pipe 112 and a inlet port 110, utilizing changes in the gravitation direction involved by the rotation of a rotor 118. Such a rotary developing apparatus has a simple structure and prevents the charging ability of the carrier from deteriorating without bringing about a significant increase in the size of the image forming apparatus or increase in its manufacturing cost, since the apparatus makes use of an inherent motion of the rotor to replenish and recover the developer.

On the other hand, Japanese Patent Application Laid-open No. 10-142888 discloses a developing apparatus as shown in annexed FIG. 12 of the present application, in which developer discharged from a developing container 101 is temporarily stored in storing portion 113 at a developing position P1 at which the developing device 101 is opposed to a photosensitive member 128, then transferred to a cylindrical shaft 118*a* disposed at the center of a rotor 118 utilizing the changes in the gravitation direction involved by the rotation of the rotor 118, and finally recovered by a developer recovering container, which is provided at an end of the cylindrical shaft 118*a*, by means of a developer transferring member 120 provided in the cylindrical shaft 118*a*. As per the above, this developing apparatus also discharges the developer by making use of an inherent motion of the rotor, like the above-described rotary developing apparatus proposed by Japanese Patent Application Laid-open No. 9-218575. Therefore, this apparatus also prevents the charging ability of the carrier from deteriorating, without bringing about an increase in the size of the image forming apparatus. In addition, with the construction of this developing apparatus, even in the case in which monochromatic (or mono-color) image formations are successively performed, surplus toner in the developing device is discharged, at the developing position, to the storing portion outside the developing device without interrupting the developing operation, so that the developing apparatus can keep the amount of the developer in the developing device within a permissible range without bringing about a decrease in image productivity.

Recently, with increases in trade of full color copying machines and full color printers, demand for a variety of functions has been placed on them. Along with this, many image forming apparatus that are pursuing high image productivity while focusing on downsizing and cost-reduction have been manufactured as commercialized products, and such apparatus are expected to be a part of the mainstream in the future.

The rotary developing apparatus described in the above-mentioned Japanese Patent Application Laid-open No. 9-218575 utilizes the rotational motion of the rotor to discharge deteriorated developer to the developer cartridge, so that its structure is simple, and that it does not involve an increase in the size of the image forming apparatus or an increase in cost. In addition, in this rotary developing apparatus, since the properties of the developer as a whole are stabilized by the gradual replacement of the deteriorated developer with new developer, exchange of the developer is not required, so that ease of maintenance is enhanced. However, in this rotary developing apparatus, since surplus developer in the developing device is not discharged to the exterior of the developing device at the developing position, when high density monochromatic images are formed successively, it is necessary, in order to prevent an increase in the developer in the developing device, to stop the developing operation to perform the developer discharging operation, i.e. to perform rotation of the rotor, even though the image formation is still carrying on. So a decrease in image productivity was inevitable. Generally speaking, it is the case that users of color image forming apparatus use them for monochromatic black image forming more often than color image forming.

On the other hand, in the developing apparatus described in the above-described Japanese Patent Application Laid-open No. 10-142888, deteriorated developer is discharged to the recovering container provided at an end of the rotor shaft so as to gradually replace the deteriorated developer with new developer, thereby stabilize the properties of the developer as a whole. Therefore, exchange of the developer is not required, so that ease of maintenance is enhanced. Furthermore, in this developing apparatus, since surplus toner in the developing device is discharged, at the developing position, to the storing portion outside the developing device, image productivity will not be lowered by the developer discharging operation. However, in this developing apparatus, since the developer stored in the storing portion is transported to the interior of the rotor shaft first and then further transported to the recovering container by means of the developer transporting member provided in the shaft, the developing apparatus needs to be equipped with various parts, the recovering container, and a driving device, which are not necessary for normal image forming operations, which has inevitably increased the complexity of the image forming apparatus and significantly increased the manufacturing cost of the apparatus.

To summarize the above, in the prior art technologies, it is true that replenishment of the developing device with not only toner but also with the carrier eliminates the need for the exchange of the deteriorated carrier as a whole so as to enhance ease of maintenance, but in the prior art arrangements, in the case of a printing job in which a plurality of monochromatic images (especially high density images) are successively formed, the image forming operation must be frequently interrupted in order to rotate the developing rotor (for the purpose of only discharging surplus developer), since in the prior arts, the surplus developer is discharged to the exterior of the developing device utilizing the rotation of the developing rotary. Therefore, it has been impossible to meet two requirements, that is, ease of maintenance and high image productivity, while attaining simplification of apparatus construction and cost reduction.

SUMMARY OF THE INVENTION

It is an object of the present invention to provide a developing apparatus that is easy to maintain and able to form images with improved productivity while eliminating failure in image formation.

It is another object of the present invention to provide a developing apparatus that is easy to maintain and able to form images with improved productivity while eliminating failure in image formation, without increasing the complexity or manufacturing cost of the apparatus.

Other objects of the present invention will be readily apparent from the following detailed description and the annexed drawings.

DETAILED DESCRIPTION OF THE PREFERRED EMBODIMENTS

In the following, an image forming apparatus according to the present invention will be described in detail with reference to the annexed drawings.

Embodiment 1

Figure 1:
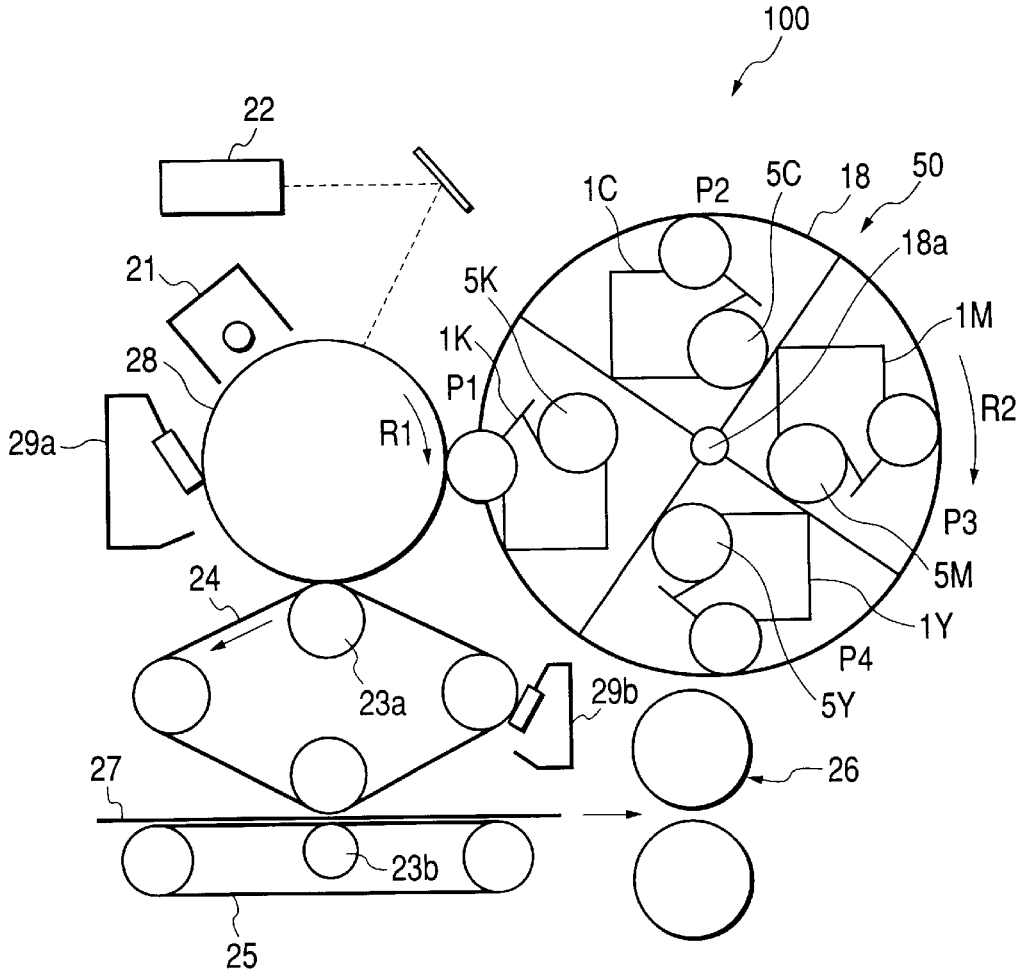
FIG. 1 is a schematic view of a principal part of an embodiment of an image forming apparatus according to the present invention.

FIG. 1 schematically illustrates the construction of an embodiment of an image forming apparatus according to the present invention. First, a description will be made of a general construction of the image forming apparatus 100 according to this embodiment that uses a rotary developing method. The image forming apparatus 100 has an electrophotographic photosensitive member in the shape of a drum, that is a photosensitive drum 28, which is rotatable in the direction indicated by an arrow R1 in FIG. 1. Around the photosensitive drum 28, there is provided a primary charger 21 functioning as charging means for charging the photosensitive drum uniformly, exposing means 22 for exposing the surface of the photosensitive drum 28 in accordance with image information so as to form an electrostatic latent image, a rotary developing apparatus 50 functioning as developing means for developing the electrostatic latent images formed on the photosensitive drum 28 with plural developing apparatus of plural colors, a first transferring charger 23*a* functioning as means for transferring a toner image formed on the photosensitive drum 28 onto an intermediate transferring belt 24 as an intermediate transferring member, and a first cleaner 29*a* for cleaning transfer residual toner remaining on the surface of the photosensitive drum after the transfer of the toner image.

The rotary developing apparatus 50 comprises a black developing apparatus 1K, a yellow developing apparatus 1Y, a magenta developing apparatus 1M, and a cyan developing apparatus 1C, each of which is supported on a rotor 18. A rotation shaft 18*a* of the rotor 18 can be rotated as desired by driving means (not shown) including a motor and a gear mechanism etc. When, for example, a black toner image is to be formed on the photosensitive drum 28, the development is performed by the black developing apparatus 1K at a developing position P1 adjacent to the photosensitive drum 28. When a yellow toner image is to be formed, the rotor 18 is rotated by just about 90 degrees in the direction of an arrow R2 in FIG. 1 to bring the yellow developing apparatus 1Y to the developing position P1 so as to perform the development. Similarly, when a magenta toner image or a cyan toner image is to be formed, the rotor is further rotated by a step(s) of just about 90 degrees in the direction of the arrow R2 in FIG. 1 to bring the magenta developing apparatus 1M or cyan developing apparatus 1C to the developing position so as to perform development.

Next, an overall operation of the image forming apparatus 100 will be described. Please note that in the following description, a general name "developing apparatus 1" is used for collectively referring to the black developing apparatus 1K, yellow developing apparatus 1Y, magenta developing apparatus 1M, and cyan developing apparatus 1C. Similarly, in descriptions in which distinction between the developing apparatus for respective colors are not necessary, suffixes K, Y, M, and C in reference characters for indicating parts belonging to respective developing apparatus will be omitted.

The surface of the photosensitive drum 28, which rotates in the direction of the arrow R1 in FIG. 1, is charged uniformly by the primary charger 21. The exposing means 21 irradiates the surface of the photosensitive drum 28 having been thus charged, with a laser beam or the like corresponding to image information so as to form an electrostatic latent image on the photosensitive drum 28. The electrostatic latent image is developed by the developing apparatus that accommodates a desired toner, so that a toner image is formed on the photosensitive drum 28.

This toner image is transferred onto the intermediate transferring belt 24 by a first transferring bias applied by the first transferring charger 23*a*. For example, in the case of the full color image formation, a black toner image is formed on the photosensitive drum 28 first at the developing position P1 by the black developing apparatus 1K, and then the black toner image is primarily transferred onto the intermediate transferring belt 24. Next, the rotor 18 is rotated in the direction of the arrow R2 in FIG. 1 by 90 degrees to bring the yellow developing apparatus 1Y to the developing position P1 so as to form a yellow toner image. Then, the yellow toner image is primarily transferred and superposed onto the black toner image on the intermediate transferring belt 24. Similar operations are sequentially performed also with respect to the magenta developing apparatus 1M and the cyan developing apparatus 1C, so that a desired full color image is formed.

On the other hand, in synchronization with the formation of the full color toner image on the intermediate transferring belt 24, a recording material 27, such as a recording paper sheet or an OHP sheet or the like, is fed from recording material supplying means (not shown) including a cassette accommodating the recording materials, a pickup roller(s), a conveying roller(s), and a conveying guide to a recording material conveying belt 25 serving as recording sheet conveying means, so that the recording sheet is delivered to a position at which the intermediate transferring belt 24 and a second transferring charger 23, which functions as transferring means, are opposed to each other.

After that, the full color image formed on the intermediate transferring member 24 is secondarily transferred as a single image onto the recording material 27 on the recording material conveying belt 25.

Subsequently, the recording material 27 is detached from the recording material conveying belt 25 so as to be applied with pressure and heat by a fixing apparatus 26. Thus, the unfixed toner image transferred on the recording material 27 is fixed to be a permanent image.

On the other hand, the transfer residual toner remaining on the photosensitive drum 28 after the primary transfer is cleared by the first cleaner 29*a*, and the transfer residual toner remaining on the intermediate transferring belt 24 is cleared by a second cleaner 29*b*, in preparation for the next image formation.

It should be noted that, in the case of monochromatic image formation, a toner image formed on the photosensitive drum 28 by the developing apparatus 1 accommodating toner of a desired color is primarily transferred onto the intermediate transferring belt 24 and secondarily transferred onto the recording material 27 immediately after the primary transfer, and then the recording material 27 is detached from the recording material conveying belt 25 so as to be applied with pressure and heat by the fixing apparatus 26, so that the monochromatic toner image transferred on the recording material 27 becomes a permanent image. The monochromatic image formation according to this process provides image productivity about four times as high as that of the full color image formation.

Next, a description will be made of the developing apparatus 1 with reference to FIGS. 2 and 3 in addition to FIG. 1.

A developing container of the developing apparatus accommodates two-component developer (which will be simply referred to as developer, hereinafter) mainly comprising non-magnetic toner (simply referred to as toner) and magnetic carrier (simply referred to as carrier). In this embodiment, the weight percentage of the toner in the developer is about 8% in its initial condition. It should be noted that this value might be varied, since the value should be adjusted in accordance with conditions such as the charge amount of the toner, the diameters of carrier particles, the structure of the image forming apparatus etc.

The developing apparatus 1 has an opening that opens as a developing area opposing to the photosensitive drum 28. A developing sleeve 3 which functions as a developer carrying member is rotatably arranged with a portion thereof exposed at the opening. The developing sleeve 3 is made of a non-magnetic material, and a fixed cylindrical magnet 4, which serves as magnetic field generation means, is provide inside the developing sleeve 3. The magnet 4 has a plurality of magnetic poles circumferentially arranged in a specific pattern like an example shown in FIG. 2, so that the carrier attached with the toner on its surface by frictional charge can be kept on the surface of the developing sleeve 3 by a magnetic field generated by the magnet 4. The developing sleeve 3 rotates, upon the developing operation, in the direction indicated by the arrow A in FIG. 2 to carry and convey the developer while picking up the developer in the developing container 2 to retain the developer in a layer on the sleeve 3 so as to supply the developer to the developing area opposed to the photosensitive drum 28. The thickness of the developer layer carried on the sleeve 3 is regulated by a developer amount regulating member 2*c* that is provided adjacent to and opposed to the developing sleeve 3. The developing sleeve 3 is applied with a developing bias given as a superposition of an AC voltage and a DC voltage to supply the toner in the developer to the electrostatic latent image on the photosensitive drum 28 so as to develop it. The developer remaining on the developing sleeve 3 after the development is conveyed with the rotation of the developing sleeve 3 and recovered into the developing container 2.

The developing container 2 is comprised of a agitation chamber and a developing chamber, which are partitioned by a partition wall and equipped with developer transferring members that are disposed substantially parallel to the axial direction of the developing sleeve 3 to transfer and agitate the developer. In this embodiment, in order for the developer to circulate between the developing chamber (which is provided with the developing sleeve) and the agitation chamber, a first developer circulating screw 2*a* and a second developer circulating screw 2*b* as the developer transferring members are provided, so that the toner and carrier are also agitated to be mixed sufficiently. In this embodiment, the circulation direction of the developer is substantially parallel to the axial direction of the developing sleeve, and from the far side to the near side in FIG. 2 on the first developer circulating screw 2*a* side, while from the near side to the far side on the second developer circulating screw 2*b* side. In this connection, in the image forming apparatus according to this embodiment, the near side in FIGS. 1 and 2 is the front side of the apparatus at which the operator is present to operate the apparatus. Driving means comprised of a motor (s) or a gear mechanism(s) etc. (none of which is shown in the drawings) may be provided for each of the developing sleeve 3, the first and second developer circulating screws 2*a* and 2*b*, or alternatively some of them may be driven by common driving means.

The developing apparatus 1 is provided with a developer replenishing port 9 on a top wall 1A (at the agitation chamber) of the developing container 2 near the second developer circulating screw 2*b*. The developing apparatus 1 is also provided, on a side end wall 2B of the agitation chamber opposite to the developing sleeve 3, with a discharging port 11 for discharging surplus developer, which is adapted to be opened and closed by a shutter member 14 as an opening/closing member. The developer discharging port 11 communicates with a developer storing chamber 13 via a first developer transferring passage 12*a*. Another portion of the developer storing chamber 13 communicates with a second developer transferring passage 12*b*, the other end opening 12*c* of which, in turn, communicates with a developer recovering port 10 of a developer cartridge 5, which serves as a developer replenishing container (or recovering container), which will be specifically described later.

The developer discharging port 11 is disposed at a level substantially the same as a top portion of the second developer circulating screw 2*b* and opens upward, when the developing apparatus 1 is at the developing position P1. The shutter member 14 is adapted to be opened and closed by its own weight so as to open the developer discharging port 11, when the developing apparatus 1 is at the developing position P1, and to close the developer discharging port 11, when the developing apparatus 1 is at the positions P2, P3 and P4 other than the developing position P1. Therefore, when the developing apparatus 1 is at the developing position P1, an increase in the amount of developer in the developing container due to replenishment with the developer will not make the level of the developer higher than the top of the second developer circulating screw 2*b*.

Therefore, when the developing container rotates from the position P1 to the position P2, from the position P2 to the position P3, or from the position P3 to the position P4, a backflow of the surplus developer into the developing container and unintended discharge of non-surplus developer from the developing container can be prevented from occurring, so that it is possible to keep the developer level in the developing container equal to or less than a prescribed level, while the surplus developer can be transferred (or conveyed) from the storing chamber to the developer replenishing container with a simple arrangement. That is to say, since it is possible to keep the developer level, image forming can be performed without deteriorating the developing ability.

Figure 2:
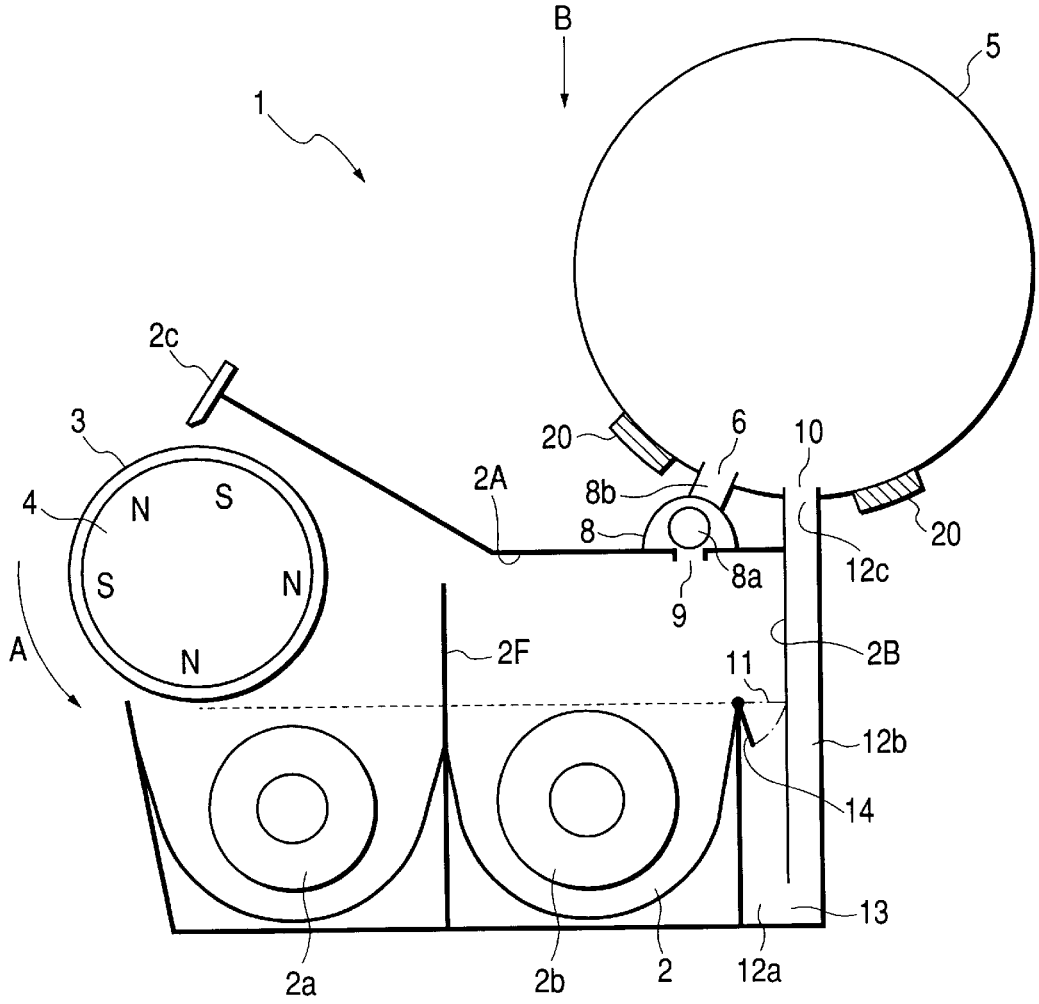
FIG. 2 is a drawing illustrating a developing apparatus and a developer cartridge of the image forming apparatus shown in FIG. 1.
Figure 3:
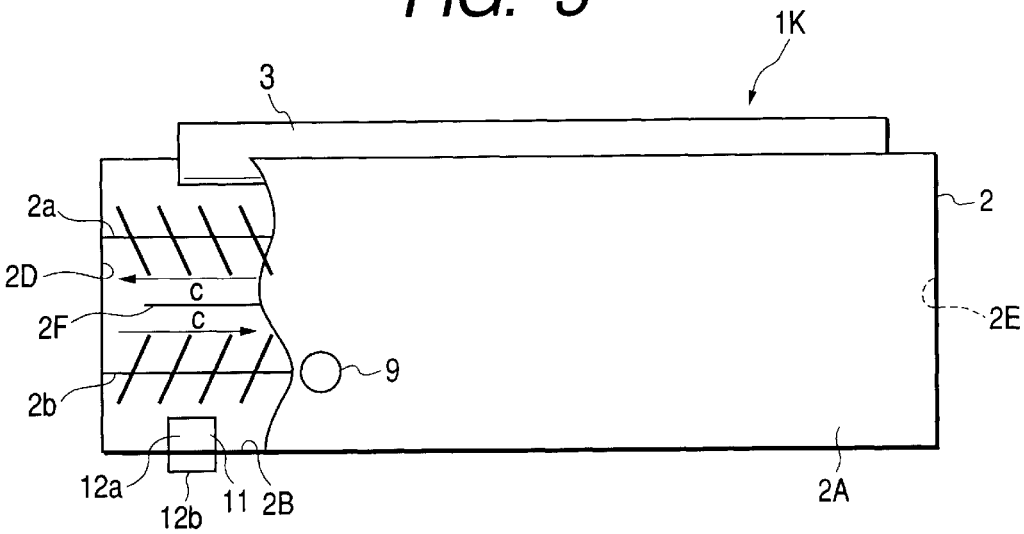
FIG. 3 is a drawing illustrating the developing apparatus seen from the direction indicated by an arrow B in FIG. 2.

FIG. 3 illustrates the developing apparatus of FIG. 2 seen from the direction of the arrow B in FIG. 2. The developer discharging port 11 is disposed in the vicinity of the second developer circulating screw 2*b* and upstream of the developer replenishing port 9 with respect to the developer circulation direction (indicated by an arrow C). Therefore, the developer discharging port does not disturb the developer circulation in the vicinity of the developing sleeve 3, nor discharge the developer that has been just replenished through the developer replenishing port 9.

In the developing container 2 of the developing apparatus 1, there is provided a partition wall 2F arranged to partition the first developer circulating screw 2*a* and the second developer circulating screw 2*b* substantially in parallel to the developer circulating screws 2*a* and 2*b*. The longitudinal ends of the partition wall 2F do not reach a near side wall 2D nor a far side wall 2E of the developing container, so that the developer is transferred from the first developer circulating screw 2*a* side to the second developer circulating screw 2*b* side through a communication portion near the left end ("left" in FIG. 3) of the partition wall 2F and from the second developer circulating screw 2*b* side to the first developer circulating screw 2*a* side through a communication portion (not shown) near the right end of the partition wall 2F.

Figure 4:
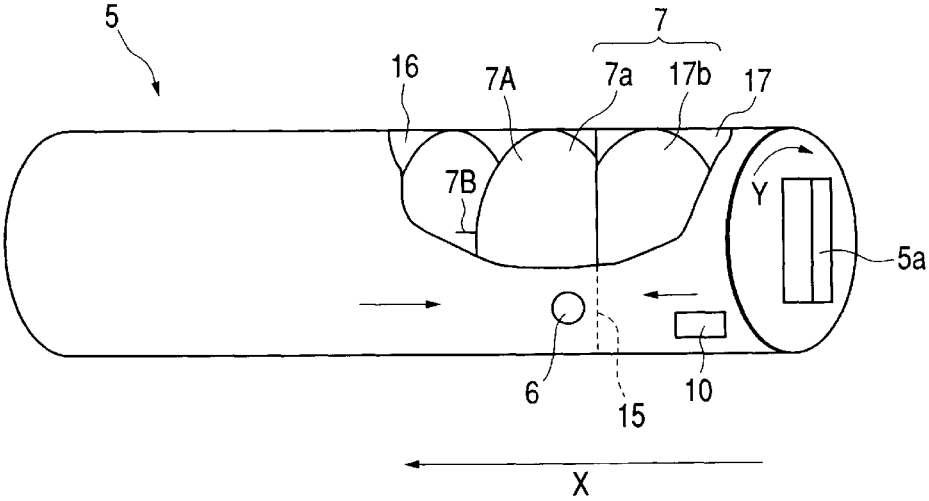
FIG. 4 is a drawing illustrating a developing cartridge for use in the image forming apparatus shown in FIG. 1.

Next, the developer cartridge 5 and a developer replenishing mechanism 8 will be described with further reference to FIG. 4. As shown in FIG. 4, the developer cartridge is of a substantially cylindrical shape and adapted to be easily attachable/detachable to/from the rotor 18 or developing apparatus 1 with attaching means 20. The developer cartridge 5 is inserted into the rotor 18 from the near side of the apparatus (in the direction indicated by an arrow X in FIG. 4), and then rotated by turning the handle 5*a* on the near side to the right (i.e. in the direction indicated by an arrow Y in FIG. 4), so that a developer supplying port 6 and a developer recovering port 10 are opened so as to be in communication with a receiving port 8*b* of the developer replenishing mechanism 8 and the end opening 12*c* of the second developer transferring passage 12*b* respectively. Such a shutter member (not shown) may be provided that is so constructed to cause the developer supplying port 6 and the developer recovering port 10 to open by the above-described attaching operation. The developer cartridge 5 can be detached from the rotor 18 through a process reverse to the above-described attaching process, in which the developer supplying port 6 and the developer recovering port 10 are closed when the handle 5*a* is turned to the left so as to be disconnected from the developer replenishing mechanism 8 and the second developer transferring passage 12*b*. With this structure, it is assured that the developer accommodated in the developer cartridge does not leak to the outside.

The interior of the developer cartridge 5 is comparted with respect to the longitudinal direction by a partition 15 into a replenishing developer accommodating chamber 16 having the developer supplying port 6 and a discharged developer accommodating chamber 17 having the developer recovering port 10. The replenishing developer accommodating chamber 16 accommodates replenishing developer for replenishing the developing apparatus 1, while the discharged developer accommodating chamber 17 accommodates discharged developer discharged from the developing apparatus. The chamber proximal to the handle 5*a* is the discharged developer accommodating chamber 17 as a recovering chamber, while the chamber farther from the handle 5*a* is the replenishing developer accommodating chamber 16 as a replenishing chamber.

The developer supplying port 6 is disposed in the vicinity of the partition 15 with respect to the longitudinal direction of the developer cartridge 5, and the developer recovering port 10 is disposed at the end opposite to the partition 10.

In the developer cartridge 5, there is further provided a transferring member 7 comprised of a replenishing developer transferring portion 7*a* for transferring the replenishing developer in the replenishing developer accommodating chamber 16 toward the developer supplying port 6 (that is, toward the partition 15, in this embodiment) and a discharged developer transferring portion 7*b* for transferring the discharged developer in the discharged developer accommodating chamber 17 away from the developer recovering port 10 (that is, toward the partition 15, in this embodiment), which are coaxially arranged. So, the developer accommodated in the discharged developer accommodating chamber 17 will not flow back out of the developer recovering port 10.

As illustrated in FIG. 4 which shows a part of the interior of the developing cartridge 5, the transferring member 7 comprises a spirally formed vane 7A made of resin film or the like and a shaft 7B with which the vane 7A is rotated. The transferring member 7 is appropriately rotated by driving means (not shown) such as a motor and a gear mechanism to transfer the developer in the developer cartridge 5. In this embodiment, the directions of spirals of the vanes 7A are arranged opposite to each other between the replenishing developer transferring portion 7*a* in the replenishing developer accommodating chamber 16 and the discharged developer transferring portion 7*b* in the discharged developer accommodating chamber 17, so that the replenishing developer and the discharged developer are transferred in the opposite directions.

The replenishing developer (comprised of toner and carrier) that includes an amount of toner corresponding to the amount consumed in the image formation is transferred, by the rotation of the transferring member 7, to the developer supplying port 6 of the developer cartridge 5, and then supplied, by virtue of its own weight, from the developer supplying port 6 to the developer replenishing mechanism 8 provided on the developing container 2 through a receiving port 8*b* thereof. Then, the developer supplied to the developer replenishing mechanism 8 is transferred toward the developer replenishing port 9 by rotation of a replenishing screw 8*a* disposed in the developer replenishing mechanism 8 as developer replenishing means, so that the developer is supplied to the interior of the developer container 2 for replenishment through the developer replenishing port 9.

The mixing ratio of the toner and the carrier in the replenishing developer is about 9:1 in this embodiment on the weight ratio basis. That is to say, the ratio of the toner is very high as compared to the mixing ratio of the toner and the carrier in the developer existing in the developing container 2. The volume ratio taken into account, such a situation may be considered as that the toner is mixed with a small amount of carrier. In other words, upon replenishing the developer container 2 with the toner that has been consumed in the image formation, a small amount of carrier is gradually supplied. If the ratio of the carrier in the replenishing developer is increased, the carrier replacement amount per the same replenishing toner amount increases. In that case, the developer in the developing container becomes fresher, but the operating cost also increases, since a carrier consumption increases. In the present invention, the mixing ratio of the toner and the carrier in the replenishing container 2 is not limited to the value set forth above, but it is preferable to determine an appropriate mixing ratio suitable for each apparatus.

The replenishing amount of the developer is generally determined by the number of revolutions of the replenishing screw 8*a*, which is controlled by replenishing toner amount controlling means (not shown). The toner replenishing amount controlling means may be arranged in such a way as to calculate a toner amount corresponding to the amount that have consumed in the image formation by e.g. counting the number of the pixels of the formed image, so as to convert it into a corresponding number of the revolutions of the replenishing screw 8*a* for controlling. Such toner replenishing amount controlling means is well known to those who are skilled in the art, so further detailed descriptions are omitted.

Next, the developer (two-component developer) used in this embodiment will be described. The The toner includes color resin particles each comprising a binder resin, a colorant and other optional additives added as circumstances demand and color particles externally added with an additive such as colloidal silica fine powder. The toner is made of a negatively chargeable polyester resin produced by polymerization. It is preferable that the volume-average particle size (or diameter) of the toner fall within the range of 5 $\mu$m to 8 $\mu$m. In this embodiment the volume-average particle size of the toner was 7.2 $\mu$m.

The carrier may preferably be made of, for example, a metal such as iron, nickel, cobalt, manganese, chromium, or a rare earth or alloy of these metals, each of which may be surficially oxidized or not oxidized, or an oxide ferrite. Manufacturing methods of these magnetic particles are not particularly limited to any specific method. The weight-average particle size (or diameter) of the carrier falls within the range of 20 $\mu$m to 50 $\mu$m, and preferably within the range of 30 $\mu$m to 40 $\mu$m. The electric resistivity of the carrier is equal to or more than $10^7$ Ωcm, and preferably equal to or more than $10^8$ Ωcm. In this embodiment, the carrier having the electric resistivity of more than $10^8$ Ωcm was used.

A phenol-type binder resin is mixed with a magnetic metal oxide and a non-magnetic metal oxide, so that a magnetic resin carrier produced by polymerization may be used as a magnetic carrier of a low specific gravity. For example, a volume-average particle size of such a carrier is 35 $\mu$m, a true density thereof is 3.6 to 3.7(g/cm$^3$), and a magnetization thereof is 53(A·m$^2$/kg).

As to the toner used in this embodiment, the volume-average particle size was measured with the following devices and method. As measuring devices, a Coulter Counter TA-II (manufactured by Coulter Corporation), an interface (manufactured by Nikkaki) and a CX-I personal computer (manufactured by Canon) were used. As an electrolytic aqueous solution, a 1% NaCl aqueous solution made by using a first class sodium chloride was used. The measuring method was as follows.

That is, 100 to 150 ml of the above-mentioned electrolytic aqueous solution was added with 0.1 ml of alkyl benzene sulfonate and 0.5 to 50 mg of the sample to be measured.

The electrolytic aqueous solution suspended with the sample was subjected to a dispersing processing by an ultrasonic disperser for 1 to 3 minutes, and then the particle size distribution was measured with respect to the particles of 2 to 40 $\mu$m, by the above-mentioned Coulter counter TA-II with an aperture of 100 $\mu$m, so that the volume-average distribution was obtained. The volume-average particle size was determined based on the obtained volume average distribution.

The electric resitivity of the carrier used in this embodiment was measured using a sandwich type cell with the measurement electrode size of 4 cm$^2$ and the distance between the electrodes of 0.4 cm, based on a method in which a voltage E(V/cm) was applied between the electrodes, while one of the electrodes was pressurized with a weight of 1 kg to determine the electric resistivity of the carrier based on the current flowing in the circuit. Furthermore, the magnetization ($A \cdot m^2/kg$) of the carrier was determined by measuring the magnetization intensity of the carrier in an external magnetic field of 79.6 kA/m (or 1000 oersted) using a magnetic characteristics automatic recording apparatus of an oscillating magnetic field type manufactured by Rikendenshi Corporation.

Next, a description will be made of a method for discharging surplus developer, which is a characteristic feature of this embodiment with further reference to FIG. 5. This surplus developer discharging method applies to each of the developing apparatus 1K, 1Y, 1M and 1C for respective colors in the same manner, so a detailed description will be made in the following with respect to the black developing apparatus 1K as a representative.

Upon completion of the developing operation by the black developing apparatus 1K at the developing position P1, the developing container 2 is replenished with the developer (two-component developer) including an amount of toner corresponding to the toner consumed in the image formation, from the developer cartridge 5K for black. At the same time, the carrier, which makes up about 10% of the toner weight, is also supplied.

In other words, every time the image formation is finished, the black developing apparatus 1K is replenished with the carrier. Especially, when a plurality of high density images are successively formed, the developing apparatus 1K is replenished with a large amount (several tens milligrams) of carrier. Therefore, the developer amount in the black developing apparatus 1K increases, so that the level of the developer tends to increase.

If the level of the developer becomes higher than the second developer circulating screw 2*b*, the second developer circulating screw 2*b* cannot agitate the developer sufficiently, unless surplus developer is discharged as described later, so that the toner just supplied is delivered to the first developer circulating screw 2*a* without being sufficiently charged so as to be used for development. In such a case, a toner fog will arise in a white portion of the formed image. Furthermore, if the developer amount increases further, the developer will spill out of the black developing apparatus 1K to contaminate the interior of the image forming apparatus.

Figure 5:
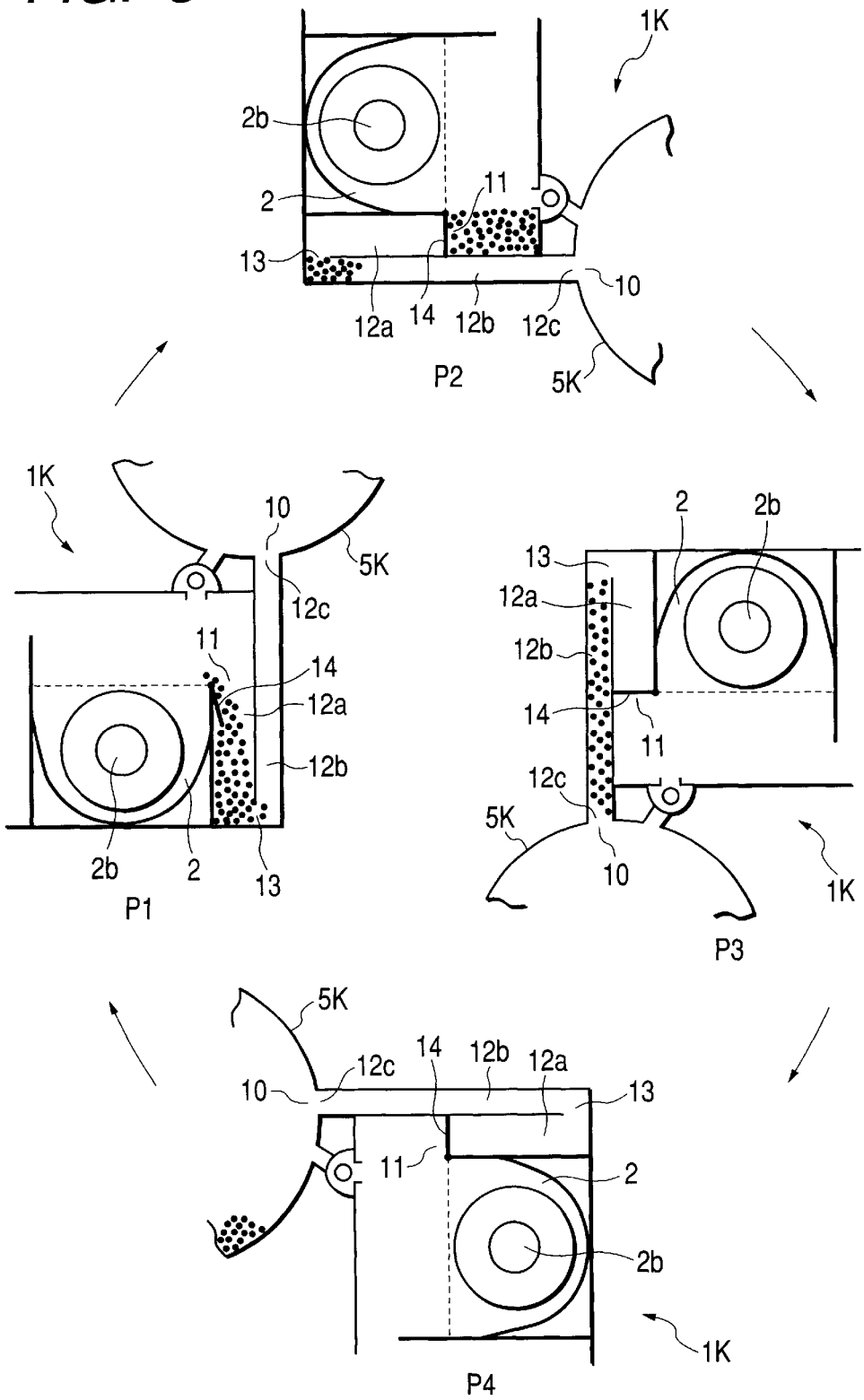
FIG. 5 is a drawing illustrating an embodiment of a developer recovering method according to the present invention.

In this embodiment, as shown in FIG. 5, the developer discharging port 11 is provided at a level the same as the top of the second developer circulating screw 2*b*. In addition, when the black developing apparatus 1K is at the developing position P1, the shutter member 14 is in its open state by virtue of its own weight.

Therefore, when the developer level is about to exceed the second developer circulating screw 2*b*, the surplus developer starts to spill through the developer discharging port 11, so that the developer level is kept to the level of the second developer circulating screw 2*b*. By virtue of this, a toner fog in a white portion of the formed image or an overspill of the developer out of the black developing apparatus will not occur.

The surplus developer discharged from the developer discharging port 11 in the developing position P1 of the black developing apparatus 1K falls, by virtue of its own weight, along the first developer transferring passage 12*a* to reach the developer storing chamber 13 so as to be stored therein. As per the above, since the surplus developer in the black developing apparatus 1K at the developing position P1 is discharged from the developer container 2 to the developer storing chamber 13, even during a printing job in which a large number of high density monochromatic (or black and white) images are successively formed, it is possible to keep the developer amount in the black developing apparatus 1K within a permissible limit without requiring particular rotational action of the rotor 18 for discharging the developer (or without requiring frequent particular rotational actions of the rotor 18). It follows that during a printing job for successively forming a large number of high density black-and-white images, an image formation interruption time due to the particular rotational action of the rotor for discharging the surplus developer can be minimized. In other words, image productivity is expected to be increased while formation of defective images is prevented.

Upon completion of the developing operation by the black developing apparatus 1K, the rotor 18 is rotated by just about 90 degrees in preparation for the next developing operation by the yellow developing apparatus 1Y, so that the black developing apparatus 1K moves to the position P2. Changes in the gravitation direction involved by this rotational action of the rotor 18 causes the developer in the developer storing chamber 13 to be transferred to the neighborhood of a portion connecting the developer storing portion 13 and the second developer transferring passage 12*b*. On the other hand, the shutter member 14 is moved only by its own weight to close the developer discharging port 11. This prevents the developer in the black developing apparatus 1K from leaking into the first developer transferring passage 12*a* through the developer discharging port 11.

Upon completion of the developing operation by the yellow developing apparatus 1Y, the rotor 18 is rotated by just about 90 degrees in preparation for the next developing operation by the cyan developing apparatus 1C, so that the black developing apparatus 1K moves to the position P3. During this rotation, the developer staying at the neighborhood of a portion connecting the developer storing portion 13 and the second developer transferring passage 12*b* is transferred, only by its own weight, along the second developer transferring passage 12*b* so as to be received into the discharged developer accommodating chamber 17 of the black developer cartridge 5K through its developer recovering port 10. It should be noted that in the position P3 also, the developer discharging port 11 of the black developing apparatus 1K is in a state closed by the shutter member 14, so that the developer in the black developing apparatus 1K does not leak through the developer discharging port 11 into the first developer transferring passage 12*a*.

According to the structure and method described above, even in a job in which monochromatic (e.g. black) images are successively formed, the developer amount in the developing apparatus can be kept within a permissible level without interrupting the developing operation during the image forming. Therefore, rotational operations of the rotor, which is extraneous to the image forming, for discharging the developer in the developing apparatus is not required, so productivity of the image is not decreased. In addition, it is possible to recover the developer including deteriorated carrier into the developer cartridge 5 utilizing changes in the gravitation direction involved by the rotational motion of the rotor 18. Therefore, it is possible to enhance stability of the developer condition and ease of maintenance without providing particular members or apparatus that are extraneous to the normal image formation, such as transferring members or driving apparatus for transferring deteriorated developer to a developer cartridge.

As described above, according to the arrangement of this embodiment, since the replacement of the developer is automatically done, the apparatus provides a good usability (or ease of maintenance). In addition, it is possible to realize an apparatus that is easy to maintain and able to form images with improved productivity while eliminating failure in the development (or image formation) with a simple structure.

Embodiment 2

In the following, another embodiment of the present invention will be described with reference to FIGS. 6 and 7. The image forming apparatus according to this embodiment differs from that of the first embodiment in structure of the developer cartridge 5, but the other structures are the same as those in the first embodiment. Therefore elements in this embodiment that have similar structures and functions as the first embodiment will be denoted with the same reference characters and detailed descriptions will be omitted.

Figure 6:
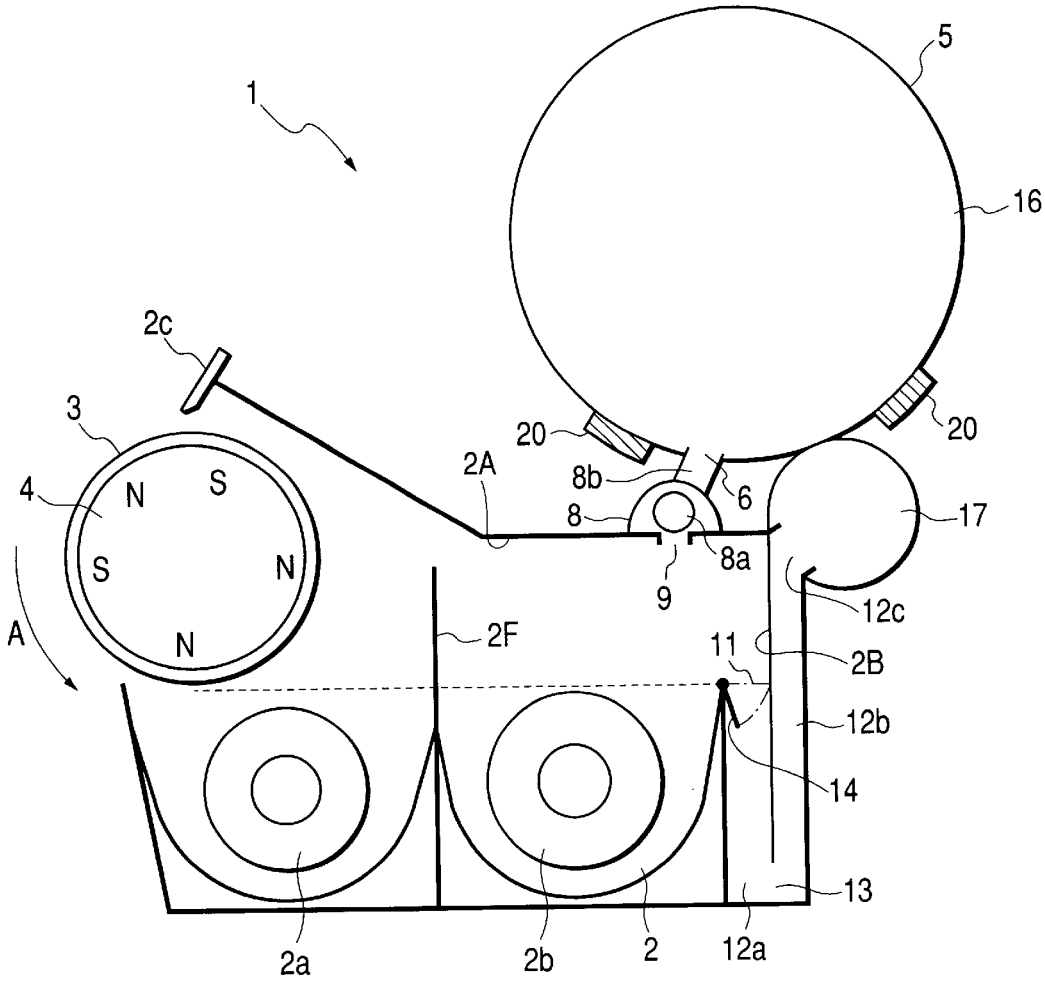
FIG. 6 is a drawing illustrating another embodiment of a developing apparatus and a developer cartridge according to the present invention.
Figure 7:
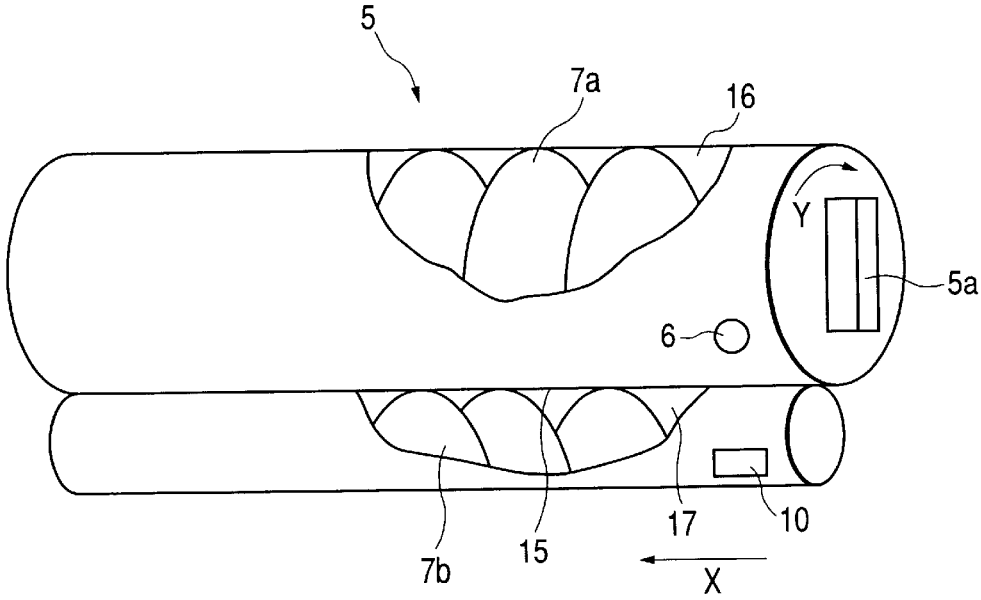
FIG. 7 is a drawing illustrating the embodiment of the developer cartridge according to the invention shown in FIG. 6.

As shown in FIGS. 6 and 7, in this embodiment the interior of the developer cartridge 5 is divided by a partition wall 15 in a substantially horizontal direction, into a replenishing developer accommodating chamber 16 that accommodates replenishing developer for replenishing the developing apparatus 1 and has a developer supplying port 6 and a discharged developer accommodating chamber 17 that accommodates discharged developer discharged from the developing apparatus and has a developer recovering port 10. The replenishing developer accommodating chamber 16 and the discharged developer accommodating chamber 17 are respectively equipped with a replenishing developer transferring member 7*a* for transferring the replenishing developer and a discharged developer transferring member 7*b* for transferring the discharged developer. Each of the transferring members 7*a* and 7*b* may be of structures similar to those in the embodiment 1.

In this embodiment, the developer supplying port 6 and the developer recovering port 10 are disposed on the same side with respect to the longitudinal direction of the cartridge 5 and in the vicinity of the side end at which a handle 5 is disposed.

In this embodiment also, a developer discharging port 11 is disposed in the vicinity of a second developer circulating screw 2*b* and upstream of a developer replenishing port 9 with respect to the developer circulation direction. Therefore, the developer discharging port 11 does not disturb the developer circulation in the vicinity of the developing sleeve 3, nor discharge the developer that has been just supplied through the developer replenishing port 9.

The replenishing developer (comprised of toner and carrier) that includes an amount of toner corresponding to the amount consumed in the image forming is supplied, by the rotation of the replenishing developer transferring member 7*a* as well as by virtue of its own weight, from the developer supplying port 6 of the developer cartridge 5 to a developer replenishing mechanism 8 provided on the developing container 2 through a receiving port 8*b* thereof. Then, the developer supplied to the developer replenishing mechanism 8 is transferred toward the developer replenishing port 9 by rotation of a replenishing screw 8*a*, so that the developer is supplied to the interior of the developer container 2 for replenishment through the developer replenishing port 9.

On the other hand, the way of discharging surplus developer in the developing container 2 is the same as that in the first embodiment, which was described above with reference to FIG. 5, so the surplus developer in the developing apparatus is accommodated in the discharged developer accommodating chamber 17 through the developer recovering port 10. The developer that has been recovered by the discharged developer accommodating chamber 17 is transferred away from the developer recovering port 10 by the discharged developer transferring member 7*b*. Therefore, the developer accommodated in the discharged developer accommodating chamber 17 will not flow back out of the developer recovering port 10.

According to the structure and method described above, like the first embodiment, productivity of the image is not lowered even in the case, for example, in which monochromatic images are successively formed. In addition, it is possible to recover the developer including deteriorated carrier into the developer cartridge 5 utilizing changes in the gravitation direction involved by the rotational motion of the rotor 18. Therefore, it is possible to enhance stability of developer condition and ease of maintenance without providing particular members or apparatus that are extraneous to the normal image formation, such as transferring members or driving apparatus for transferring deteriorated developer to the developer cartridge.

As per the above, according to the structure of this embodiment, advantageous effects similar to those which were described above with respect to the first embodiment can be attained. Furthermore, in this embodiment, since the discharged developer accommodating chamber 17 is disposed in a space between the developing apparatus 1 and the rotation shaft 18*a* of the rotor 18, the longitudinal dimension of the replenishing developer accommodating chamber can be made as long as that of the developing container 2 or the photosensitive drum 28, so that it can accommodate a large amount of replenishing developer. Therefore, operating costs of the apparatus can be lowered.

Embodiment 3

Figure 8:
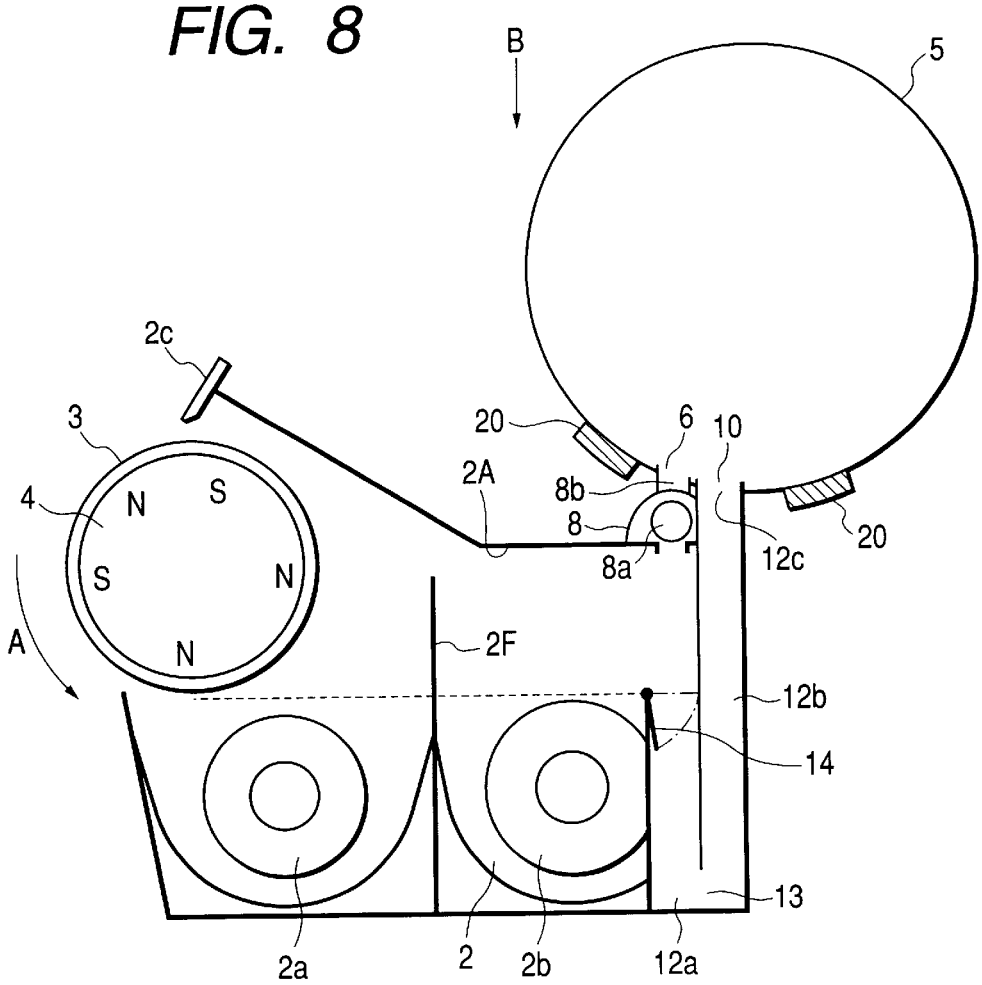
FIG. 8 is a drawing illustrating a still other embodiment of a developing apparatus and a developer cartridge according to the present invention.
Figure 9:
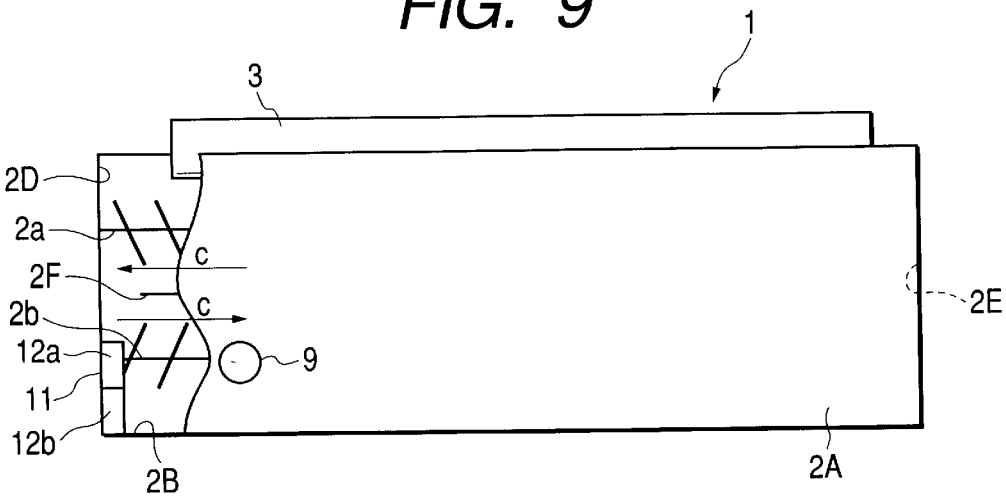
FIG. 9 is a drawing illustrating the developing apparatus seen from the direction indicated by an arrow B in FIG. 8.

In the following, a still other embodiment of the present invention will be described with reference to FIGS. 8 to 10. The image forming apparatus according to this embodiment has a structure basically the same as that of the first embodiment except for the positions of a developer replenishing port 9 and a developer discharging port 11 in the developing apparatus 1. Therefore elements in this embodiment that have similar structures and functions as the first embodiment will be denoted with the same reference characters and detailed descriptions will be omitted.

First, a description will be made of the position of the developer discharging port 11 of the developing apparatus, which is a characteristic feature of the present invention. As shown in FIGS. 8 and 9, in this embodiment, a developer discharging port 11 is disposed in the vicinity of a second developer circulating screw 2*b* and on a side wall 2D on the near side of the developing apparatus at which the developer is transferred from a first developer circulating screw 2*a* to the second developer circulating screw 2*b*. The developer discharging port 11 opens upward at the level same as the top of the second developer circulating screw 2*b*.

In this embodiment also, the developer discharging port 11 is disposed in the vicinity of the second developer circulating screw 2*b* and upstream of a developer replenishing port 9 with respect to the developer circulation direction. Therefore, the developer discharging port 11 does not disturb the developer circulation in the vicinity of the developing sleeve 3, nor discharge the developer that has been just supplied through the developer replenishing port 9.

As per the above, in contrast to the first embodiment, it is possible to dispose the developer replenishing port 9 of the developing container 2 at an upstream-most position with respect to the developer transferring position of the second developer circulating screw 2*b*. That is to say, it is possible to extend a time (or path length) required for transferring the developer that has been just supplied, to the first developer circulating screw 2*a*, so that the toner that has been just supplied can be sufficiently agitated and charged. Therefore, even in the case in which high density images are successively formed and the developing container 2 is successively replenished with a large amount of developer, the toner just supplied is transferred to the first developer circulating screw 2*a* side in a sufficiently charged state so as to be used for development, so a toner fog on a white portion of the formed image can be eliminated or reduced.

The structure of the developer cartridge 5 used in this embodiment is similar to that in the first embodiment, but the positions of a developer supplying port 6 and a developer recovering port 10 may be changed to match with the positions of the developer replenishing port 9 and developer discharging port 11 of the developer container 2.

Figure 10:
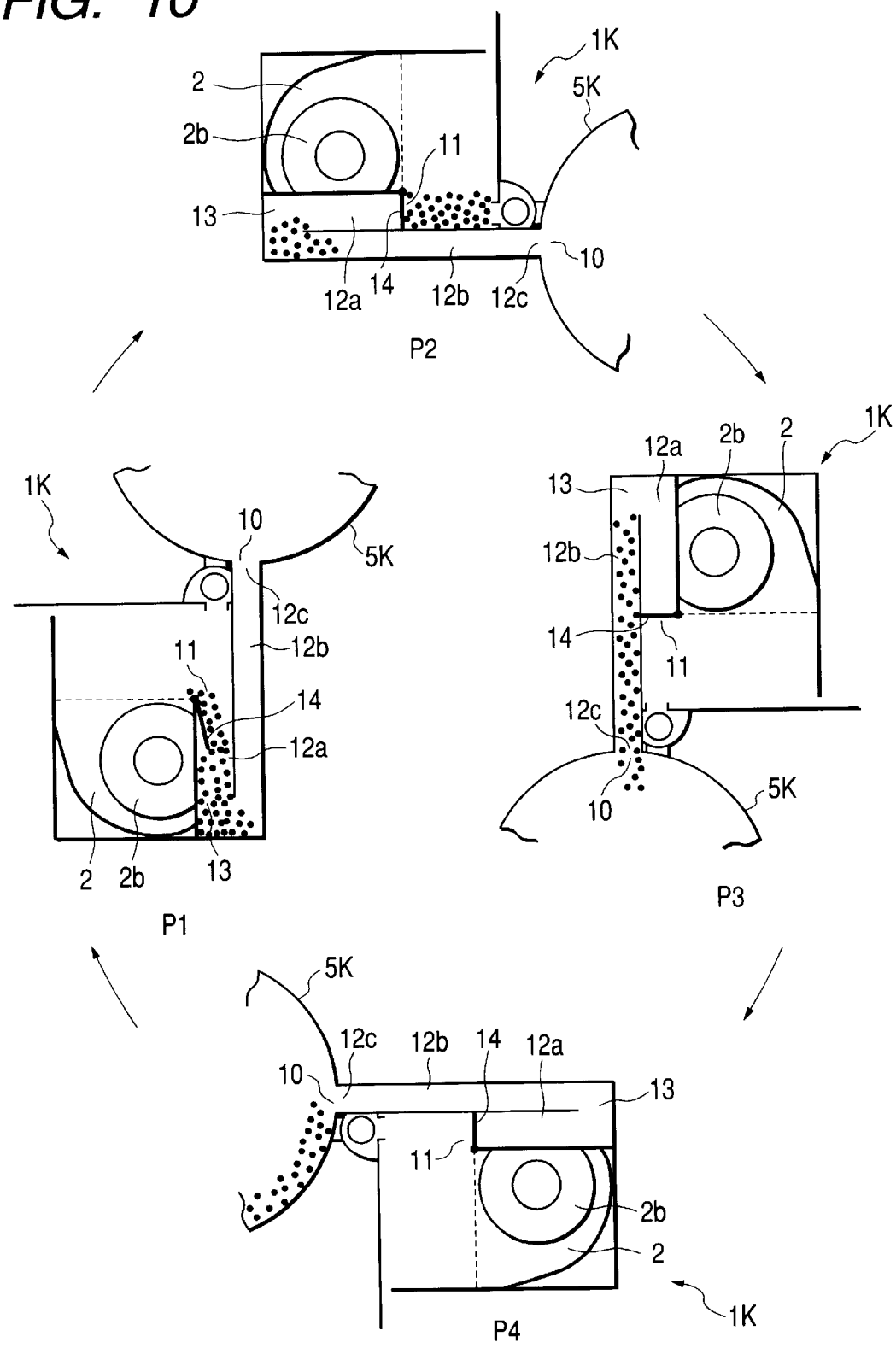
FIG. 10 is a drawing illustrating another embodiment of a developer recovering method according to the present invention.
Figure 11:
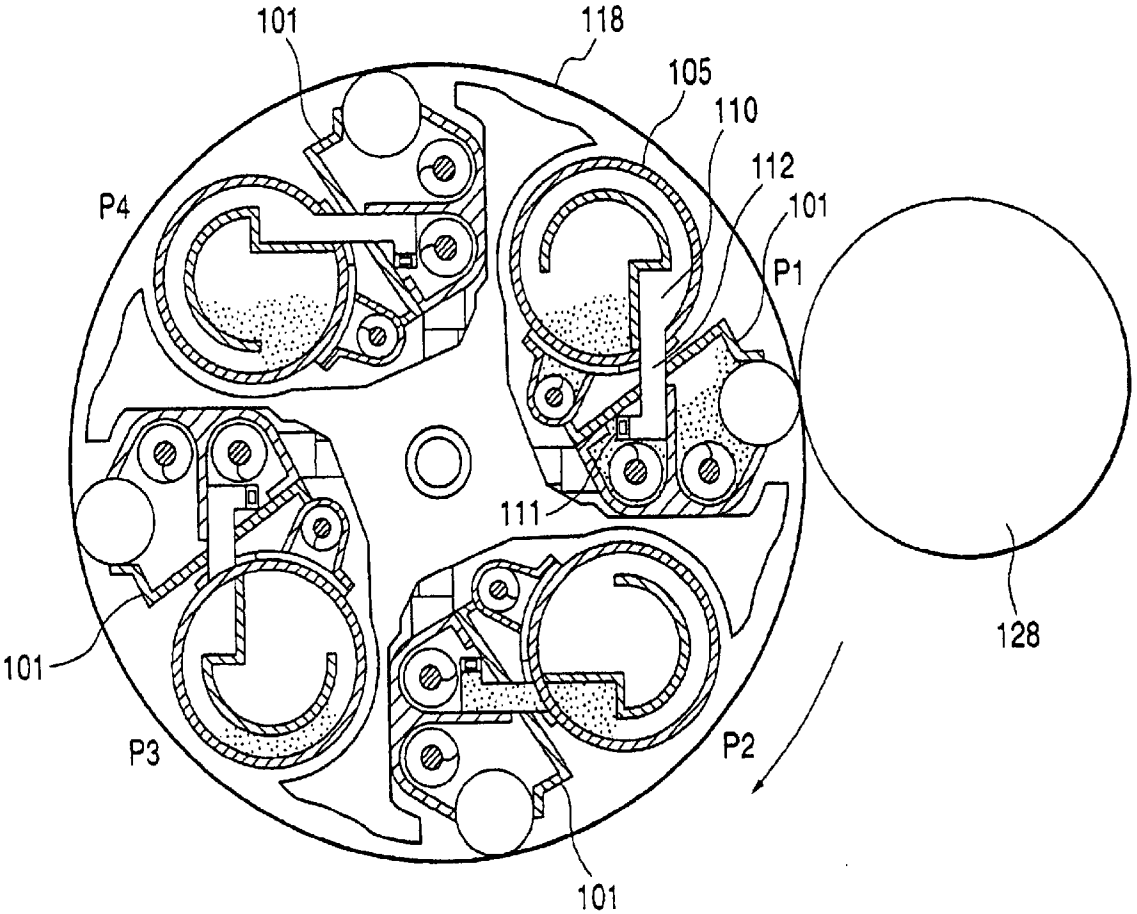
FIG. 11 PRIOR ART
FIG. 11 is a drawing illustrating an example of a rotary developing apparatus according to a prior art.
Figure 12:
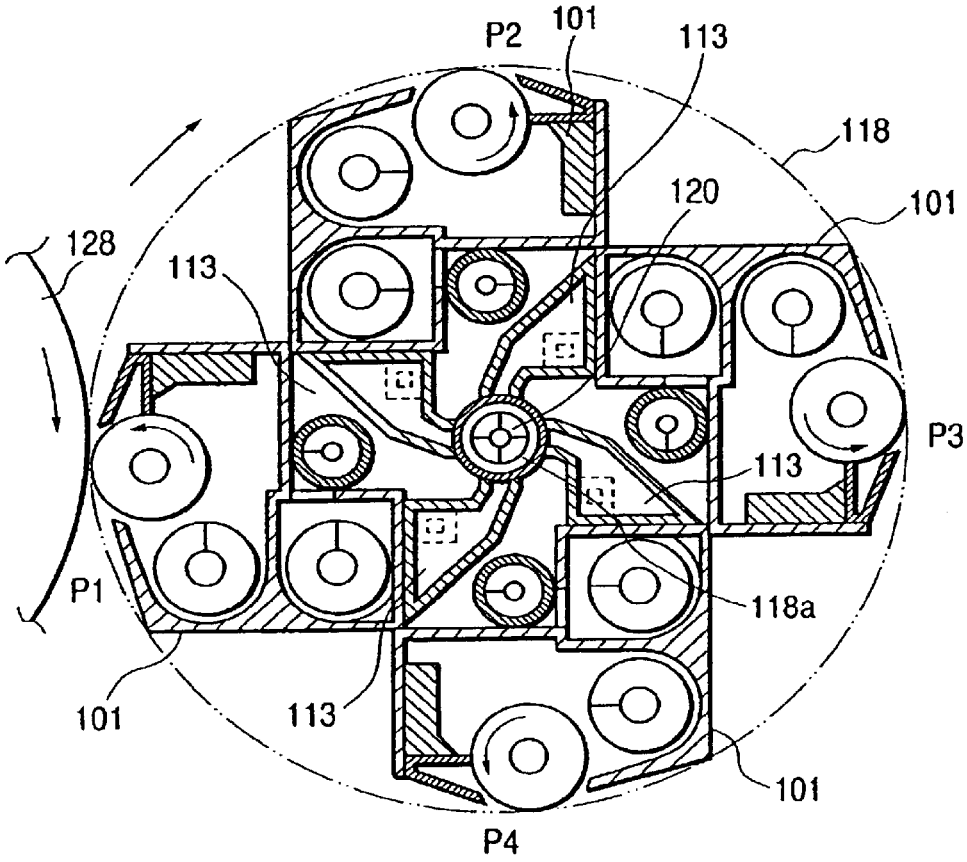
FIG. 12 PRIOR ART
FIG. 12 is a drawing illustrating another example of a rotary developing apparatus according to a prior art.

As shown in FIG. 10, a method for discharging surplus developer in the developing container 2 in this embodiment is similar to that in the first embodiment. Here, a description will be made of the black developing apparatus 1K as a representative.

In this embodiment also, a shutter member 14 is provided at the developer discharging port 11. The developer discharging port 11 is in communication with a developer storing chamber 13 via a first developer transferring passage 12*a*. Another portion of the developer storing chamber 13 communicates with a second developer transferring passage 12*b*, which, in turn, communicates with the developer recovering port 10 of the developer cartridge 5. The shutter member 14 is adapted to be opened and closed by its own weight so as to keep the developer discharging port 11 open, when the developing apparatus 1 is at the developing position P1, and to keep the developer discharging port 11 closed, when the developing apparatus 1 is at the positions P2, P3 and P4 other than the developing position P1.

As will be seen in FIG. 10, when the black developer 1K is at the developing position P1, the developer discharging port 11 is disposed at the same level as a top portion of the second developer circulating screw 2*b*, and the shutter member 14 is in its open state by virtue of its own weight to keep the developer discharging port 11 open. Therefore, when the developer level is about to exceed the second developer circulating screw 2*b*, the surplus developer is discharged from the developer discharging port 11, so that the developer level is kept to the level of the second developer circulating screw 2*b*. With this structure, the apparatus of this embodiment eliminates a toner fog on a white portion of the formed image or a leakage of the developer from the developing apparatus 1, which would occur unless the surplus developer is discharged.

The surplus developer discharged from the developer discharging port 11 in the developing position P1 of the black developing apparatus 1K falls, by virtue of its own weight, along the first developer transferring passage 12*a* to reach the developer storing chamber 13 so as to be stored therein. As per the above, in this embodiment also, since the developer storing chamber 13 is provided to discharge the surplus developer in the black developing apparatus 1K at the developing position P1 from the developer container 2, it is possible to keep the developer amount in the black developing apparatus 1K within a permissible limit without requiring particular rotational action of the rotor 18 for discharging the developer, even in the case in which a large number of high density monochromatic images are successively formed. Therefore, productivity of the image is not decreased.

Upon completion of the developing operation by the black developing apparatus 1K, the rotor 18 is rotated by just about 90 degrees in preparation for the next developing operation by the yellow developing apparatus 1Y, so that the black developing apparatus 1K moves to the position P2. Changes in the gravitation direction involved by this rotational action of the rotor 18 causes the developer in the developer storing chamber 13 to be transferred to the neighborhood of a portion connecting the developer storing portion 13 and the second developer transferring passage 12*b*. On the other hand, the shutter member 14 is moved by its own weight to close the developer discharging port 11. This prevents the developer in the black developing apparatus 1K from leaking into the first developer transferring passage 12*a* through the developer discharging port 11.

Upon completion of the developing operation by the yellow developing apparatus 1Y, the rotor 18 is rotated by just about 90 degrees in preparation for the next developing operation by the cyan developing apparatus 1C, so that the black developing apparatus 1K moves to the position P3. During this rotation, the developer staying at the neighborhood of a portion connecting the developer storing portion 13 and the second developer transferring passage 12*b* is transferred, by its own weight, along the second developer transferring passage 12*b* so as to reach the developer recovering port 10 of the black developer cartridge 5K, through which the developer is received into the discharged developer accommodating chamber 17. It should be noted that the developer discharging port 11 of the black developing apparatus 1K is closed by the shutter member 14 also in the position P3 of the black developing apparatus 1K, so that the developer in the black developing apparatus 1K does not leak through the developer discharging port 11 into the first developer transferring passage 12*a*.

According to the structure and method described above, like the first embodiment, even in a job in which monochromatic (e.g. black) images are successively formed, productivity of the image is not decreased. In addition, it is possible to recover the developer including deteriorated carrier into the developer cartridge 5 utilizing changes in the gravitation direction involved by the rotational motion of the rotor 18. Therefore, it is possible to enhance stability of the developer condition and ease of maintenance without providing particular members or apparatus that are extraneous to normal image formation, such as transferring members or driving apparatus for transferring deteriorated developer to a developer cartridge.

As will be appreciated from the above descriptions, this embodiment realizes advantageous effects similar to those described with respect to the first embodiment. In addition, in this embodiment, the time (or agitating and transferring distance) taken up for transporting the developer supplied to the interior of the developing container 2 for development is extended (or elongated), so it is possible to sufficiently agitate and charge the supplied toner, even in the case in which a large amount of developer is successively supplied.

While the invention has been described with reference to the embodiments disclosed herein, the invention is not limited to the embodiments, and various modifications can be made to the structures of the embodiments. For example, in the embodiments set forth above, the image forming apparatus uses an intermediate transferring method. But the invention is not intended to include any limitation concerning a transferring method, and other transferring methods that are well know to those skilled in the art, such as transferring toner images sequentially onto a recording material carried by a recording material carrier, may be adopted.

What is claimed is:

1. A developing apparatus comprising:

a developing container which accommodates a developer including a toner and a carrier to develop, at a developing position, an electrostatic image formed on an image bearing member;

a rotor which rotates said developing container in a path that includes said developing position;

a developer replenishing container which replenishes said developing container situated at said developing position by said rotor with the developer including the toner and the carrier;

an opening which is provided on a side surface of said developing container to allow surplus developer to spill out of said developing container situated at said developing position by said rotor;

a recovering container which recovers the surplus developer discharged from said opening utilizing a rotational motion of said rotor; and an opening/closing member which open and close said opening.

2. A developing apparatus according to claim 1, wherein said opening/closing member shifts by virtue of its own weight from a state in which said opening/closing member keeps said opening closed to a state in which said opening/closing member keeps said opening open, as said developing container is rotated by said rotor to approach said developing position, and shifts by virtue of its own weight from a state in which said opening/closing member keeps said opening open to a state in which said opening/closing member keeps said opening closed, as said developing container is rotated by said rotor to move away from said developing position in order for the surplus developer to be transferred to said recovering container.

3. A developing apparatus according to claim 2, wherein said recovering container is detachably mounted on said rotor.

4. A developing apparatus according to claim 3 wherein said recovering container is provided integrally with said developer replenishing container.

5. A developing apparatus according to any one of claims 1 to 4, wherein said developer replenishing container is detachably mounted on said rotor, and when said developing container is situated at said developing position by said rotor, said developer replenishing container is situated above said developing container to replenish said developing container with the toner and carrier utilizing a gravitational force.

6. A developing apparatus according to claim 5, further comprising a storing chamber which stores the surplus developer having been discharged, through said opening, from said developing container situated at said developing position by said rotor, wherein the surplus developer in said storing chamber is transferred to a recovering chamber provided in said developer replenishing container utilizing a rotational motion of said rotor.

7. A developing apparatus according to claim 6, wherein said storing chamber is provided integrally with said developing container.

8. A developing apparatus comprising:

a developing container which accommodates a developer including a toner and a carrier to develop, at a developing position, an electrostatic image formed on an image bearing member;

a rotor which rotates said developing container in a path that includes said developing position;

a developer replenishing container which replenishes said developing container situated at said developing position by said rotor with the developer including the toner and the carrier;

an opening which is provided on a side surface of said developing container to allow surplus developer to spill out of said developing container situated at said developing position by said rotor; and a storing chamber which stores the surplus developer having been discharged, through said opening, from said developing container situated at said developing position by said rotor;

wherein the surplus developer in said storing chamber is transferred to a recovering chamber provided in said developer replenishing container utilizing a rotational motion of said rotor.

9. A developing apparatus according to claim 8, wherein said developer replenishing container is detachably mounted on said rotor, and when said developing container is situated at said developing position by said rotor, said developer replenishing container is situated above said developing container to replenish said developing container with the toner and carrier utilizing a gravitational force.

10. A developing apparatus according to claim 9, wherein said storing chamber is provided integrally with said developing container.

* * * * *

UNITED STATES PATENT AND TRADEMARK OFFICE

CERTIFICATE OF CORRECTION

PATENT NO. : 6,920,301 B2
DATED : July 19, 2005
INVENTOR(S) : Kota Arimoto

It is certified that error appears in the above-identified patent and that said Letters Patent is hereby corrected as shown below:

Column 1,
Line 65, “a inlet” should read -- an inlet --.

Column 3,
Line 6, “stabilize” should read -- stabilizing --.

Column 5,
Line 14, “are not” should read -- is not --.

Column 6,
Line 39, “provide” should read -- provided --; and
Line 62, “a agitation” should read -- an agitation --.

Column 10,
Line 13, “The” should be deleted.

Column 12,
Line 53, “operations” should read -- operation --.

Column 14,
Line 32, “a still other” should read -- still another --;
Line 51, “level same” should read -- same level --;
Lines 60 and 67, “been just” should read -- just been --.

Column 15,
Line 1, “been just” should read -- just been --.

Column 16,
Line 5, “causes” should read -- cause --; and
Line 64, “know” should read -- known --.

UNITED STATES PATENT AND TRADEMARK OFFICE

CERTIFICATE OF CORRECTION

PATENT NO. : 6,920,301 B2
DATED : July 19, 2005
INVENTOR(S) : Kota Arimoto

It is certified that error appears in the above-identified patent and that said Letters Patent is hereby corrected as shown below:

Column 17,
Line 21, “open and close” should read -- opens and closes --; and
Line 39, “claim 3” should read -- claim 3, --.

Signed and Sealed this

Sixth Day of December, 2005

JON W. DUDAS
*Director of the United States Patent and Trademark Office*